US009794709B2

(12) United States Patent
Jung

(10) Patent No.: US 9,794,709 B2
(45) Date of Patent: Oct. 17, 2017

(54) SYSTEM FOR MASKING VEHICLE NOISE AND METHOD FOR THE SAME

(71) Applicant: HYUNDAI MOTOR COMPANY, Seoul (KR)

(72) Inventor: In Soo Jung, Suwon-Si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 50 days.

(21) Appl. No.: 14/936,239

(22) Filed: Nov. 9, 2015

(65) Prior Publication Data

US 2016/0372103 A1 Dec. 22, 2016

(30) Foreign Application Priority Data

Jun. 18, 2015 (KR) ..... 10-2015-0086701

(51) Int. Cl.

| | |
|---|---|
| ***G10K 11/16*** | (2006.01) |
| ***H04R 3/02*** | (2006.01) |
| ***H04R 29/00*** | (2006.01) |
| ***G10K 11/178*** | (2006.01) |

(52) U.S. Cl.

CPC ..... *H04R 29/004* (2013.01); *G10K 11/178* (2013.01); *G10K 2210/1282* (2013.01); *G10K 2210/3016* (2013.01); *H04R 2410/05* (2013.01); *H04R 2499/13* (2013.01)

(58) Field of Classification Search

CPC ..... G10K 2210/128; G10K 2210/1282; G10K 2210/3013; G10K 2210/1788; G10K 2210/30231; G10K 11/175; G10K 11/16; G10K 11/1782; G10K 11/1784; G10K 11/1786; G10K 11/1788; H04R 2410/05; H04R 2499/13; F02D 2200/025

USPC ..... 381/71.1, 71.4, 71.13, 71.14, 73.1

See application file for complete search history.

(56) References Cited

U.S. PATENT DOCUMENTS

| | | | | |
|---|---|---|---|---|
| 8,199,923 | B2 * | 6/2012 | Christoph | G10K 11/1784 381/71.1 |
| 2005/0152557 | A1 * | 7/2005 | Sasaki | H04S 7/302 381/58 |
| 2008/0181422 | A1 * | 7/2008 | Christoph | G10K 11/1784 381/73.1 |
| 2009/0319160 | A1 * | 12/2009 | Callahan | F02D 9/04 701/111 |
| 2014/0025258 | A1 * | 1/2014 | Lem | B60N 2/448 701/36 |
| 2015/0043744 | A1 * | 2/2015 | Lagodzinski | H04R 3/002 381/73.1 |

(Continued)

FOREIGN PATENT DOCUMENTS

| | | |
|---|---|---|
| JP | 3502594 B2 | 3/2004 |
| JP | 2008-153743 A | 7/2008 |
| JP | 5245791 B2 | 7/2013 |

(Continued)

*Primary Examiner* — William A Jerez Lora

(74) *Attorney, Agent, or Firm* — McDermott Will & Emery LLP

(57) ABSTRACT

A method for masking a vehicle noise includes setting a noise-generated driving region in which the vehicle noise is generated while a vehicle is running; measuring the vehicle noise in the noise-generated driving region; determining a masking sound which cancels the vehicle noise based on the measured vehicle noise; and outputting the determined masking sound into an interior of the vehicle.

12 Claims, 4 Drawing Sheets

(56) References Cited

U.S. PATENT DOCUMENTS

2015/0131808 A1* 5/2015 Lennstrom ..... G10K 11/175
381/73.1

FOREIGN PATENT DOCUMENTS

KR 10-2003-0050260 A 6/2003
KR 10-2012-0060513 A 6/2012

* cited by examiner

SYSTEM FOR MASKING VEHICLE NOISE AND METHOD FOR THE SAME

CROSS-REFERENCE TO RELATED APPLICATION

This application claims priority to and the benefit of priority to Korean Patent Application No. 10-2015-0086701 filed in the Korean Intellectual Property Office on Jun. 18, 2015, the entire content of which is incorporated herein by reference.

TECHNICAL FIELD

The present disclosure relates to a system for masking vehicle noise that masks and controls undesired noises such as a high frequency combustion noise generated in an interior of a vehicle, and a method for the same.

BACKGROUND

Generally, when a vehicle is running, a combustion noise is generated in an engine compartment of the vehicle and flows into an interior of the vehicle.

Such a combustion noise may be generated and propagate into the interior of the vehicle in various magnitudes depending on opening angles of engine valves associated with an engine rotational speed and an accelerator pedal effort, the number of passengers, or various temperature conditions of the interior of the vehicle.

The combustion noise is generated as a low frequency combustion noise or a high frequency combustion noise depending on a driving condition of the vehicle. The low frequency combustion noise may be reduced by calculating a phase of the low frequency combustion noise and then outputting a reverse-phase sound through a speaker installed in the interior of the vehicle.

However, it is difficult to effectively reduce a high frequency combustion noise generated in the vehicle. Accordingly, when the vehicle is running, a driver may feel a sense of fatigue due to the high frequency combustion noise.

The above information disclosed in this Background section is only to enhance the understanding of the background of the invention, and therefore, it may contain information that does not form the prior art that is already known in this country to a person of ordinary skill in the art.

SUMMARY

The present disclosure has been made in an effort to provide a system for masking vehicle noise that are capable of masking an undesired noise such as a high frequency combustion noise and the like generated in an interior of a vehicle, and a method for the same.

According to an exemplary embodiment of the present inventive concept, a method for masking vehicle noise includes: setting a noise-generated driving region in which the vehicle noise is generated while a vehicle is running; measuring the vehicle noise in the noise-generated driving region; determining a masking sound which cancels the vehicle noise based on the measured vehicle noise; and outputting the determined masking sound to an interior of the vehicle.

The noise-generated driving region may be set by receiving a drivers input through an input.

The input may include a button operator and a voice operator that are installed in the interior of the vehicle and set a start point and an end point of the noise-generated driving region.

The button operator may be installed at a steering wheel or a dash board of the vehicle.

The step of measuring may be repeatedly performed two or more times.

The step of measuring may be performed by using a microphone installed in the interior of the vehicle.

The step of determining may include: analyzing a type of noise generated in the interior of the vehicle; and determining the masking sound which corresponds to the type of noise.

The type of noise may include a combustion noise generated from an engine or a whine noise generated from a transmission and the like apart from the engine.

The masking sound may be set based on a masking frequency and masking decibels (dB).

The step of outputting may be performed by using a speaker or a vibrator installed in the interior of the vehicle.

According to another embodiment of the present inventive concept, a system for masking vehicle noise includes an input on which a driver sets a noise-generated driving region in which the vehicle noise is generated while a vehicle is running; a noise measurer configured to measure the vehicle noise in the noise-generated driving region set by the input; a controller configured to receive a signal of the vehicle noise measured by the noise measurer and to determine a masking sound which cancels the vehicle noise; and a masking sound output configured to output the masking sound into the interior of the vehicle according to a control of the controller.

The input may include a button operator and a voice operator that are installed in the interior of the vehicle and set a start point and an end point of the noise-generated driving region.

The button operator may be installed at a steering wheel or a dashboard of the vehicle.

The noise measurer may include a microphone installed in the interior of the vehicle.

The controller may determine the masking sound based on a masking frequency and masking decibels (dB) which correspond to the vehicle noise generated in the noise-generated driving region.

The masking sound output may include a speaker and a vibrator that are installed in the interior of the vehicle and output the masking sound.

According to the embodiments of the present inventive concept, it is possible to output a masking sound having a frequency and higher decibels than those of a vehicle noise into the interior of a vehicle such that the vehicle noise such as a high frequency combustion noise generated in the vehicle may be masked. Accordingly, the high frequency combustion noise generated from the engine may be effectively reduced, thereby improving driver's satisfaction.

DETAILED DESCRIPTION OF THE EMBODIMENTS

Figure 1:
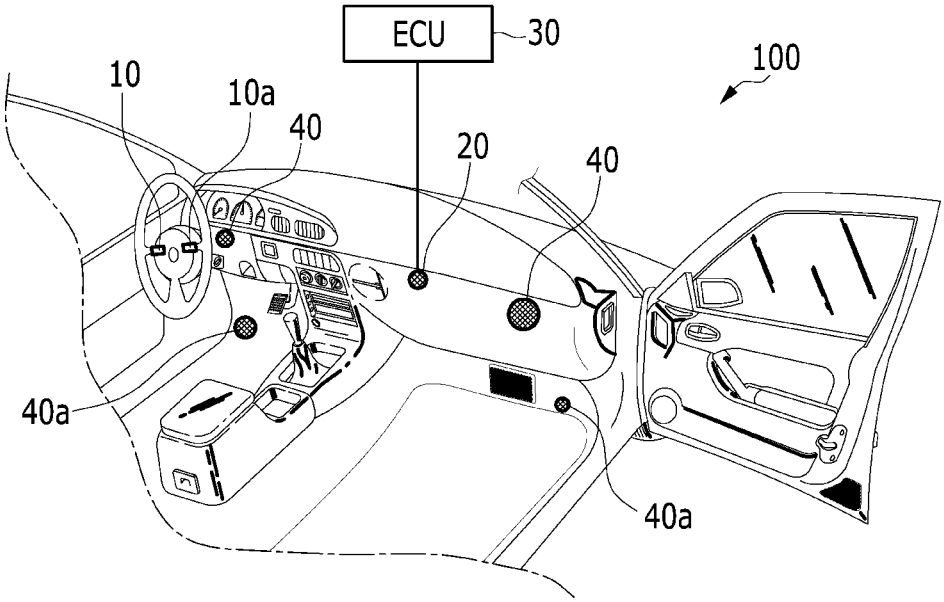
FIG. 1 illustrates a partial perspective view of a system for masking vehicle noise system according to an exemplary embodiment of the present inventive concept.

The present disclosure will be described more fully hereinafter with reference to the accompanying drawings, in which exemplary embodiments are shown. As those skilled in the art would realize, the described embodiments may be modified in various different ways, all without departing from the spirit or scope of the present disclosure. The drawings and description are to be regarded as illustrative in nature and not restrictive. Like reference numerals designate like elements throughout the specification.

Figure 2:
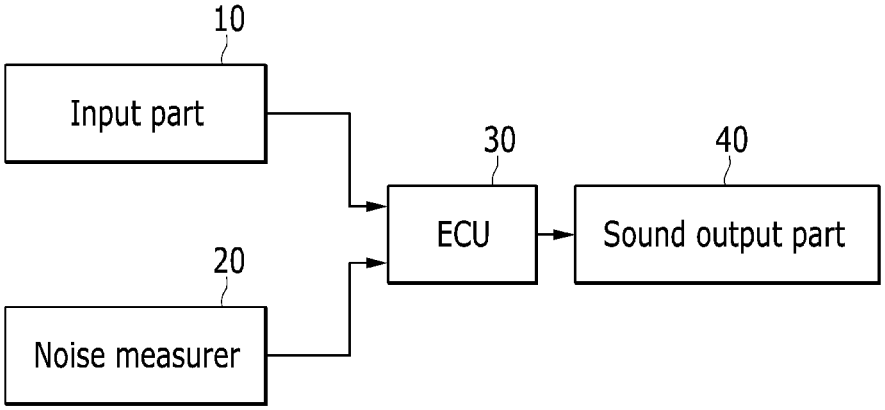
FIG. 2 illustrates a schematic block diagram of the system of FIG. 1.

FIG. 1 illustrates a partial perspective view of a system for masking vehicle noise according to an exemplary embodiment of the present inventive concept, and FIG. 2 illustrates a schematic block diagram of the system of FIG. 1.

As shown in FIGS. 1 and 2, a system for masking vehicle noise 100 according the present disclosure includes an input 10 through which a driver sets a noise-generated driving region in which noise is generated while a vehicle is running. A noise measurer 20 measures a vehicle noise in the noise-generated driving region set by the input 10. A controller 30 is configured to receive a signal of the vehicle noise measured by the noise measurer 20 and determines a masking sound which cancels the vehicle noise. A masking sound output 40 outputs the masking sound to the interior of the vehicle depending on a control by the controller 30.

The input 10 is installed in the interior of the vehicle, and sets the noise-generated driving region. The input 10 is operated by operation of the driver and is applied as a button operator 10 installed at a steering wheel or dash board of the vehicle in the present disclosure. However, the input 10 is not limited to the button operator 10, and may further include a voice operator 10*a*. Hereinafter, the voice operator 10*a* and the button operator 10 will be referred to by the same reference numeral 10.

As such, the input 10 is installed in the interior of the vehicle and controlled by an operation of the driver, and inputs the noise-generated driving region set by the driver.

That is, the driver may select and set a region in which a noise disturbed to a vehicle operation is generated by using input 10, while the vehicle is running.

More specifically, the driver may identify a vehicle noise generated during the vehicle operation of increasing or decreasing an engine RPM by controlling an accelerator pedal of the vehicle. Further, the driver may input a range in which a degree of noise that may be disturbed to the vehicle operation is generated by using the input 10.

That is, the driver may set the noise-generated driving region by respectively inputting a start point and an end point of the noise-generated driving region through the button operator of the input 10. Here, an input signal of the noise-generated driving region inputted through the input 10 may be inputted to a vehicle electronic control unit (ECU, not shown). Although the input of the start point and the end point of the noise-generated driving region are exemplarily described as being performed by the button operator 10 in the present disclosure, it is not limited thereto, and may be performed by the voice operator 10. For example, the input of the start point and the end point of the noise-generated driving region may be selectively inputted by a button operation or a voice input by installing both the button operator 10 and the voice operator 10 in the interior of the vehicle.

The vehicle noise generated in the noise-generated driving region inputted through the input 10 may be measured by the noise measurer 20.

The noise measurer 20 is installed in the interior of the vehicle, and may measure a combustion noise generated from the engine or a whine noise generated from a transmission and the like apart from the engine. The noise measurer 20 may be applied as a microphone installed in the interior of the vehicle in the present disclosure. Hereinafter, the noise measurer and the microphone will be referred to as the same reference numeral 20.

The microphone 20 may be installed as a single part in the interior of the vehicle, or at least two microphones may be respectively installed at two points to be able to effectively measure the noise. The vehicle noise measured through the microphone 20 is transmitted to the controller 30.

The controller 30 receives the vehicle noise measured by the microphone 20 and then analyzes a type of the vehicle noise. The controller 30 may be applied as the ECU installed in the vehicle. The controller 30 identifies a type of noise generated in the interior of the vehicle, and may determine a masking sound cancelling the noise.

Figure 3:
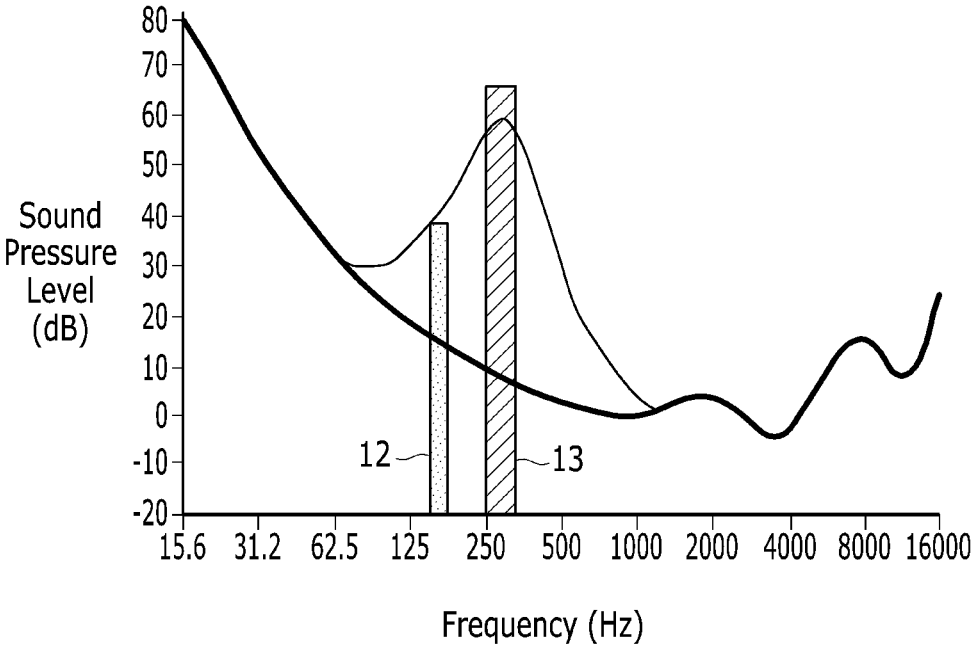
FIG. 3 illustrates a schematic graph of a masking sound determined by a controller to correspond to a vehicle noise.

FIG. 3 illustrates a schematic graph of a masking sound determined by a controller to correspond to a vehicle noise.

As shown in FIG. 3, the controller 30 may determine a masking sound 13 by using a masking frequency and masking decibels (dB) corresponding to a vehicle noise 12 generated in the noise-generated driving region. In this case, the masking sound 13 may have a frequency and higher decibels than those of the vehicle noise. The masking sound 13 may be outputted in the interior of the vehicle through the sound output 40.

The sound output 40 is installed in the interior of the vehicle, and outputs the masking sound 13 into the interior of the vehicle such that the vehicle noise may be cancelled. Here, the sound output 40, which is applied as at least two speakers installed in the interior of the vehicle, will be exemplarily described. The masking sound 13, which has the higher frequency and decibels than those of the vehicle noise, may mask a high frequency combustion noise of a range of about 1 kHz to 4 kHz generated in the vehicle. Accordingly, the high frequency combustion noise generated from the engine may be effectively reduced, thereby improving driver's satisfaction.

The sound output 40 may further include a vibrator 40*a* generating a masking sound.

The vibrator 40*a* is installed in the interior of the vehicle, and may be vibrated to correspond to the masking sound. In the present disclosure, at least two vibrators 40*a* may be installed at a driver's seat, a passenger's seat, etc., of the interior of the vehicle. Accordingly, the noise generated in the interior of the vehicle is appropriately cancelled, thereby improving satisfaction of vehicle driving.

Figure 4:
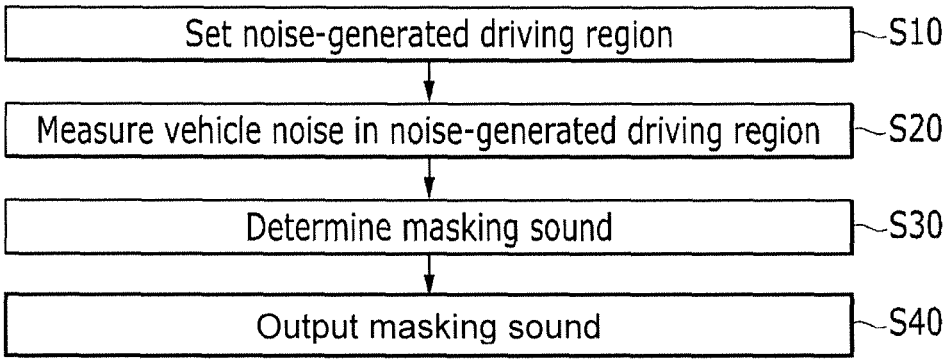
FIG. 4 illustrates a flowchart of a method for masking vehicle noise according to an exemplary embodiment of the present inventive concept.

FIG. 4 illustrates a flowchart of a method for masking vehicle noise according to an exemplary embodiment of the present inventive concept. The same reference numerals as those in FIGS. 1 to 3 refer to the same or like members having the same or like functions. A detailed description of the same reference numerals will be omitted hereinafter. Hereinafter, the method for masking vehicle noise will be described in detail with reference to FIG. 4.

First, when a vehicle is running, a driver sets a noise-generated driving region in which a noise is generated (S10). In step S10, the driver identifies a vehicle noise generated during vehicle operation while increasing or decreasing an engine RPM of the vehicle by controlling an accelerator pedal of the vehicle, and then sets a noise-generated driving region. In the setting of the noise-generated driving region, the driver may input a range in which a degree of noise that may disturb occupants of the vehicle by using the input 10.

That is, the driver may set a start point and an end point of the noise-generated driving region by using the input 10 including the button operator 10 or the voice operator 10.

Next, the vehicle noise is measured in the noise-generated driving region set at step S10 (S20). In step S20, the vehicle noise, for example, a combustion noise generated from a vehicle engine or a whine noise generated from a transmission and the like except for the engine may be measured. The measurement of the vehicle noise may be performed by the microphone installed in the interior of the vehicle. In step S20, the vehicle noise generated in the noise-generated driving region may be repeatedly measured two or more times to improve measurement accuracy.

Subsequently, the vehicle noise generated in the noise-generated driving region of step S20 is transmitted such that a masking sound cancelling the vehicle noise may be determined (S30).

More particularly, a type of noise generated in the interior of the vehicle is first analyzed in step S30. Here, the type of noise may be the combustion noise generated from the engine of the vehicle or whine noise generated from the transmission and the like except for the engine.

Subsequently, a masking sound corresponding to the noise of step S30 may be determined.

In step S30, the masking sound may be determined by using a masking frequency and a number of masking decibels (dB) corresponding to the vehicle noise generated in the noise-generated driving region. Here, the masking sound 13 may have a frequency of a higher decibel reading than that of the vehicle noise.

Next, the masking sound determined at step S30 is outputted to the interior of the vehicle (S40). The masking sound may be outputted to the interior of the vehicle through the speaker installed in the interior of the vehicle, in step S40. In step S40, the masking sound, which has the higher frequency and decibel than those of the vehicle noise, may mask a high frequency combustion noise of a range of about 1 kHz to 4 kHz generated in the vehicle.

Accordingly, the high frequency combustion noise generated from the engine may be effectively reduced, thereby improving driver's satisfaction.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for masking a vehicle noise, comprising:

setting a noise-generated driving region in which the vehicle noise is generated while a vehicle is running;

measuring, by a microphone, the vehicle noise in the noise-generated driving region;

determining, by a controller, a masking sound based on the measured vehicle noise; and outputting the determined masking sound to an interior of the vehicle, wherein the noise-generated driving region is set by receiving a driver's input through an input, wherein the input includes a button operator and a voice operator which are installed in the interior of the vehicle and which set a start point and an end point of the noise-generated driving region, and wherein the step of measuring is repeatedly performed two or more times.

2. The method of claim 1, wherein the button operator is installed at a steering wheel or a dash board of the vehicle.

3. The method of claim 1, wherein the microphone is installed in the interior of the vehicle.

4. The method of claim 1, wherein the step determining includes:

analyzing a type of noise generated in the interior of the vehicle; and determining the masking sound which corresponds to the type of noise.

5. The method of claim 4, wherein the type of noise includes a combustion noise generated from a vehicle engine or a whine noise generated from a transmission and the like.

6. The method of claim 4, wherein the masking sound is set based on a masking frequency and masking decibels (dB).

7. The method of claim 1, wherein the step of outputting is performed by using a speaker or a vibrator installed in the interior of the vehicle.

8. A system for masking vehicle noise, comprising:

an input on which a driver sets a noise-generated driving region in which the vehicle noise is generated while a vehicle running;

a microphone configured to measure the vehicle noise in the noise-generated driving region set by the input;

a controller configured to receive a signal of the vehicle noise measured by the microphone and to determine a masking sound; and a masking sound output configured to output the masking sound into the interior of the vehicle according to a control of the controller, wherein the noise-generated driving region is set by receiving a driver's input through an input, wherein the input includes a button operator and a voice operator which are installed in the interior of the vehicle and which set a start point and an end point of the noise-generated driving region, and wherein the step of measuring is repeatedly performed two or more times.

9. The system of claim 8, wherein the button operator is installed at a steering wheel or a dash board of the vehicle.

10. The system of claim 8, wherein the microphone is installed in the interior of the vehicle.

11. The system of claim 8, wherein the controller determines the masking sound based on a masking frequency and a masking decibel (dB) which correspond to the vehicle noise generated in the noise-generated driving region.

12. The system of claim 8, wherein the masking sound output includes a speaker and a vibrator installed in the interior of the vehicle.

* * * * *